United States Patent [19]

Yuuki

[11] 4,191,147

[45] Mar. 4, 1980

[54] EGR/IGNITION TIMING CONTROL SYSTEM FOR AN INTERNAL COMBUSTION ENGINE

[75] Inventor: Kiyoshi Yuuki, Susono, Japan

[73] Assignee: Toyota Jidosha Kogyo Kabushiki Kaisha, Toyota, Japan

[21] Appl. No.: 940,649

[22] Filed: Sep. 8, 1978

[30] Foreign Application Priority Data

Mar. 8, 1978 [JP] Japan ..... 53-26148

[51] Int. Cl.[2] ..... F02P 5/04; F02M 25/06

[52] U.S. Cl. ..... 123/117 A; 123/119 A

[58] Field of Search ..... 123/117 A, 119 A

[56] References Cited

U.S. PATENT DOCUMENTS

| | | | |
|---|---|---|---|
| 3,915,132 | 10/1975 | Thornburgh | 123/117 A |
| 4,031,869 | 6/1977 | Onishi et al. | 123/117 A |
| 4,083,335 | 4/1978 | Ohata | 123/117 A |
| 4,098,245 | 7/1978 | Ohata | 123/117 A |
| 4,124,006 | 11/1978 | Rodenkirch | 123/117 A X |

*Primary Examiner*—Tony Argenbright

*Attorney, Agent, or Firm*—Finnegan, Henderson, Farabow

[57] ABSTRACT

An EGR/ignition timing control system for an internal combustion engine having a vacuum advancer and an EGR system, wherein the control system includes a vacuum valve which is operated at the same critical vacuum as an EGR valve of the EGR system so as to trap, in cooperation with a check valve, the maximum vacuum supplied to the vacuum advancer as long as the EGR valve is opened and is effecting exhaust gas recirculation.

3 Claims, 3 Drawing Figures

EGR/IGNITION TIMING CONTROL SYSTEM FOR AN INTERNAL COMBUSTION ENGINE

BACKGROUND OF THE INVENTION

The present invention relates to an ignition timing control system for an internal combustion engine having an exhaust gas recirculation (EGR) system, and particularly to an EGR/ignition timing control system which provides the desirable vacuum advancing of ignition timing in relation to EGR control so as to adapt ignition timing to EGR operation of the engine.

An EGR system, which recirculates a part of the exhaust gases of an engine from its exhaust system to its intake system, has an EGR passage and an EGR valve incorporated in the EGR passage and is adapted to recirculate a controlled amount of exhaust gases from the exhaust system to the intake system in accordance with operational conditions of the engine. Such an EGR valve is generally a vacuum-operated diaphragm valve which has a diaphragm means and is adapted to be opened when the diaphragm means is supplied with a vacuum greater than a predetermined level, wherein the vacuum supplied to the diaphragm means is taken from a vacuum port provided in the intake system of the engine so as to open to the intake passage at a position which is upstream of the throttle valve incorporated in the intake passage when the throttle valve is fully closed and which is downstream of the throttle valve when it is opened beyond a predetermined opening. The vacuum taken from this vacuum port changes in accordance with the opening of the throttle valve in such a manner that when the throttle valve is fully closed, as when the engine is idling, the vacuum is of zero level; when the throttle valve is gradually opened from its fully closed position so as to traverse the front area of the vacuum port, the vacuum abruptly increases; when the throttle valve is opened somewhat more, the vacuum decreases in turn as the throttle opening increases; when the throttle valve is opened further so as to exceed approximately 50°, the vacuum remains constant generally in the range of −5 to −60 mm Hq depending upon the rotational speed of the engine; and when the throttle valve is opened still further, the vacuum again gradually increases as the rotational speed of the engine increases. Therefore, if the EGR valve is designed so as to be opened when its diaphragm means is supplied with a vacuum greater than, for example, −60 mm Hq, the EGR system is automatically controlled in a manner such that the exhaust gas recirculation is not effected when the engine is idling, or is operating at low speed with the throttle valve being fully closed or slightly opened, or when the engine is operating at high load with the throttle valve being widely opened, and such that the exhaust gas recirculation is performed only in the medium load operation between idling, or low speed operation, and high load operation. An EGR valve of the aforementioned kind is generally so constructed as to have a relatively sharp on-off performance at its set vacuum so that if the set vacuum is, for example, −60 mm Hg, the EGR valve begins to open when the vacuum supplied to its diaphragm means reaches −60 mm Hg and is nearly fully opened when the vacuum reaches −70 mm Hg.

When exhaust gas recirculation is performed in an engine, it is desirable that the ignition timing of the engine should be advanced at the rate of about one degree by crank angle per 1% of exhaust gas recirculation in order to compensate for the decrease of combustion speed of the fuel-air mixture due to exhaust gas recirculation. However, in the conventional diaphragm type vacuum advancer which has a diaphragm means and is adapted to advance ignition timing in accordance with the vacuum taken from an advancer port similar to the aforementioned vacuum port of the EGR system and supplied to its diaphragm means, because of the mechanical restrictions imposed thereon with regard to the dimensions of the diaphragm means, the rate of advance of ignition timing available relative to the magnitude of vacuum is limited to about 2° by crank angle (1° by distributor angle) per 10 mm Hg increase of vacuum. Therefore, when the engine is operated in such a condition that the vacuum taken out from the vacuum port is slightly greater than the set vacuum of the EGR valve, the EGR valve is already widely opened so as to effect the designed maximum exhaust gas recirculation, while on the other hand the vacuum advancing of ignition timing is yet small or medium thereby causing the engine to operate with a substantially delayed ignition timing in view of the influence of exhaust gas recirculation and therefore to operate with a relatively lower output power and a relatively higher fuel consumption rate.

SUMMARY OF THE INVENTION

It is therefore the object of the present invention to deal with the aforementioned problem and to provide an improved EGR/ignition timing control system which provides such a vacuum advancing of ignition timing that is well adapted to the requirements for vacuum advancing of ignition timing caused by exhaust gas recirculation.

In accordance with the present invention, the above-mentioned object is accomplished by providing an EGR/ignition timing control system in an internal combustion engine having an intake system which has an intake passage, a throttle valve incorporated in said intake passage, and a vacuum port which opens to said intake passage at a position which is upstream of said throttle valve when it is fully closed and which is downstream of said throttle valve when it is opened beyond a predetermined opening, an EGR system having an EGR passage and an EGR valve which has a first diaphragm means and opens said EGR passage when said first diaphragm means is supplied with a vacuum greater than a predetermined level, and a vacuum advancer which has a second diaphragm means and advances ignition timing in accordance with the vacuum supplied to said second diaphragm means, wherein said EGR/ignition timing control system comprises a vacuum valve which has a third diaphragm means and a valve port which is closed by said valve element when said third diaphragm means is supplied with a vacuum greater than a predetermined level, a check valve, first, second, and third passage means which individually connect said first, second and third diaphragm means to said vacuum port, said second passage means incorporating therein a parallel connection of said valve port of said vacuum valve and said check valve, and said check valve being so directed as to allow fluid to flow only from said second diaphragm means towards said vacuum port.

In accordance with a modification of the present invention, the aforementioned vacuum valve may be constructed so as to have a third diaphragm means, a valve element operated by said third diaphragm means, and first, second and third ports the connections between which are controlled by said valve element, and so as to operate in a manner such that when the vacuum supplied to said third diaphragm means is below a predetermined value, said first and second ports are connected with each other so as to establish a fluid passage therethrough, while on the other hand when said third diaphrag means is supplied with a vacuum greater than a predetermined value, said first port is isolated from said second port and is connected with said third port. In this case said second passage means which connects said second diaphragm means of said vacuum advancer to said vacuum port is so arranged that a passage means connects said second diaphragm means to said first port of said vacuum valve and other passage means connect said second and third ports of said vacuum valve to said vacuum port, wherein said check valve may be provided at a middle portion of the passage means which connects said third port of said vacuum valve to said vacuum port. This modification contributes to simplifying the arrangement of passage means and to providing a more compact control system.

BRIEF DESCRIPTION OF THE DRAWINGS

The present invention will become more fully understood from the detailed description given hereinbelow and the accompanying drawings which are given by way of illustration only and thus are not limitative of the present invention, and wherein.

DESCRIPTION OF THE PREFERRED EMBODIMENT

Figure 1:
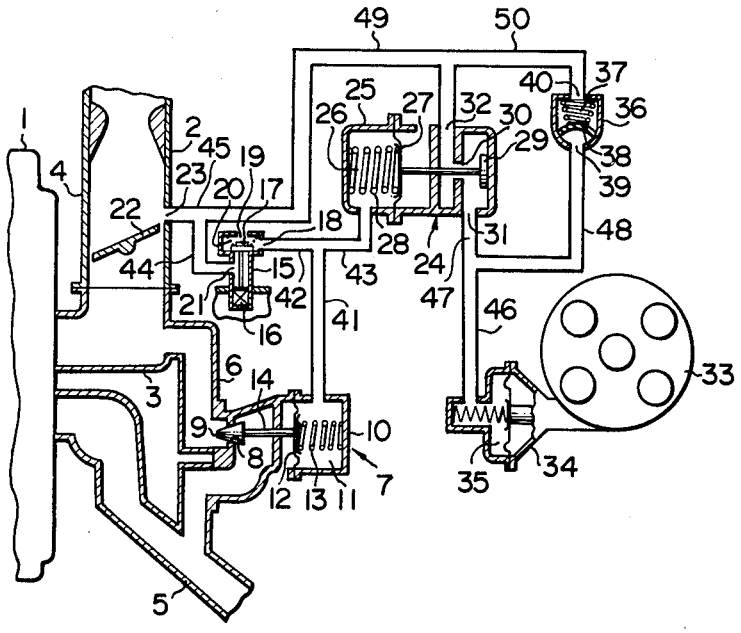
FIG. 1 is a diagrammatical view showing an embodiment of the EGR/ignition timing control system of the present invention.

Referring to FIG. 1, designates an engine which has an intake system 4 including a carburetor 2 and an intake manifold 3, an exhaust system such as an exhaust manifold 5, and an EGR system including a passage means 6 for recirculating a part of the exhaust gases flowing through the exhaust manifold from the exhaust system to the intake system and an EGR valve 7 incorporated in the passage means so as to control the flow of exhaust gases recirculated through the passage means 6. The EGR valve 7 has a valve element 9 which opens or closes a valve port 8 formed in the passage means 6 and a diaphragm means 10 which operates the valve element in such a manner that when the diaphragm chamber 11 of the diaphragm means is not supplied with a vacuum greater than a predetermined level, the diaphragm 12 of the diaphragm means is urged leftward in the figure by a compression coil spring 13 so as to drive the valve element 9 through a stem 14 toward the valve port 8 thereby intercepting the EGR passage provided by the passage means 6, and when the diaphragm chamber 11 is supplied with a vacuum greater than a predetermined level, the diaphragm 12 is shifted rightward in the figure against the action of the compression coil spring 13 so as to remove the valve element 9 from the valve port 8 thereby opening the EGR passage provided by the passage means 6.

15 is a thermostatic valve which responds to engine temperature and comprises a thermostat portion 16 adapted to detect, for example, the temperature of engine cooling water which represents engine temperature and a valve element 17 adapted to be actuated by the thermostat portion. When engine temperature is below a predetermined value, the valve element 17 is shifted to the position shown in FIG. 1 so as to connect a port 18 to an atmospheric port 19 while interrupting connection between the port 18 and a port 21, while on the other hand if engine temperature is above a predetermined value, the value element 17 is shifted upward in the figure by the thermostat element 16 against the action of a compression coil spring 20 so as to isolate the port 18 from the atmospheric port 19 and to connect the port 18 to the port 21. By this thermostat valve being incorporating in the EGR/ignition timing control system of the present invention, the control system is actuated only when engine temperature is above a predetermined value.

22 designates a throttle valve incorporated in the intake system of the engine. 23 designates a vacuum port which opens to the intake passage of the intake system at the position which is upstream of the throttle valve 22 when it is fully closed and which is downstream of the throttle valve when it is opened beyond a predetermined opening.

24 designates a vacuum valve which is of a diaphragm type operated by a diaphragm means 25 in a manner such that when the diaphragm chamber 26 of the diaphragm means is not supplied with a vacuum greater than a predetermined value, the diaphragm 27 is shifted rightward in the figure by the action of a compression coil spring 28 so that a valve element 29 connected with the diaphragm 27 opens a valve port 30 thereby connecting ports 31 and 32, while on the other hand when the diaphragm chamber 26 is supplied with a vacuum greater than a predetermined value, the diaphragm 27 is shifted leftward in the figure against the action of the compression coil spring 28 so that the valve element 29 closes the port 30 thereby isolating the ports 31 and 32 from each other.

33 designates a distributor and 34 designates a vacuum advancer which operates upon the distributor. The vacuum advancer has a diaphragm chamber 35 and is adapted to increase vacuum advancing of ignition timing in accordance with increase of the vacuum supplied to the diaphragm chamber 35.

36 designates a check valve which has a valve element 38 which is resiliently pushed downward in the figure by a compression coil spring 37 and is adapted to allow fluid to flow only from its port 39 to its port 40.

The diaphragm chamber 11 of the EGR valve 7 is connected to the port 18 of the thermostat valve 15 by passage means 41 and 42. The diaphragm chamber 26 of the vacuum valve 24 is also connected to the port 18 of the thermostat valve 15 by passage means 43 and 42. On the other hand, the port 21 of the thermostat valve 15 is connected to the vacuum port 23 by passage means 44 and 45. The diaphragm chamber 35 of the vacuum advancer 34 is connected to the port 31 of the vacuum valve 24 by passage means 46 and 47, while on the other hand the diaphragm chamber 35 of the vacuum advancer 34 is also connected to the port 39 of the check valve 36 by passage means 46 and 48. The port 32 of the vacuum valve 24 is connected to the vacuum port 23 by passage means 49 and 45. The port 40 of the check valve 36 is connected to the vacuum port 23 by passage means 50, 49 and 45.

The EGR/ignition timing control system shown in FIG. 1 operates as follows. When engine temperature is below a predetermined value, the valve element 17 of the thermostat valve 15 is shifted to the position shown in FIG. 1 so as to open the port 18 to the atmosphere while isolating the ports 18 and 21 from each other. In this condition the diaphragm chamber 11 of the EGR valve 7 is supplied with atmospheric pressure, whereby the EGR valve closes the valve port 8 so as to intercept the EGR passage provided by the passage means 6. In this condition, therefore, no exhaust gas recirculation is effected regardless of the opening of the throttle valve 22. In this condition the diaphragm chamber 26 of the vacuum valve 24 is also supplied with atmospheric pressure, whereby the valve port 30 is opened so as to connect the ports 31 and 32 with each other thereby connecting the diaphragm chamber 35 of the vacuum advancer 34 constantly to the vacuum port 23. In this condition, therefore, vacuum advancing of ignition timing is performed in the conventional manner in accordance with the opening of the throttle valve 22.

When engine temperature rises above a predetermined value so that the valve element 17 of the thermostat valve 15 is shifted upward in the figure against the action of the compression coil spring 20 thereby connecting the ports 18 and 21 with each other, the diaphragm chamber 11 of the EGR valve 7 is connected to the vacuum port 23. In this condition the exhaust gas recirculation is performed in accordance with opening of the throttle valve 22. That is, if the throttle valve 22 is fully closed, i.e. if the engine is idling or operating at low speed, no substantial vacuum appears in the vacuum port 23 thereby causing the EGR valve 7 to close. In this condition, therefore, no exhaust gas recirculation is effected. When the throttle valve 22 is gradually opened from its fully closed position so as to traverse the front area of the vacuum port 23, the vacuum in the vacuum port abruptly increases and when the vacuum increases beyond a predetermined set level for the EGR valve 7, the valve is opened so as to effect exhaust gas recirculation. When the throttle valve 22 is further opened, the vacuum in the vacuum port 23 reaches the maximum value and then begins to decrease gradually until it finally traverses the set level downward so that the EGR valve 7 is again closed.

On the other hand, the diaphragm chamber 26 of the vacuum valve 24 is supplied with the same vacuum as the diaphragm chamber 11 of the EGR valve 7, and if the vacuum valve 24 is so designed that the critical vacuum level for the on and off operation of the vacuum valve is the same as the critical vacuum level for the on and off operation of the EGR valve 7, the port 30 of the vacuum valve is closed so as to isolate the ports 31 and 32 from each other when the EGR valve 7 is opened so as to effect exhaust gas recirculation, and when the EGR valve 7 is closed so as not to effect exhaust gas recirculation, the port 30 is opened so as to connect the ports 31 and 32 with each other. When the throttle valve 22 is opened from its full closed position, the vacuum in the vacuum port 23 rapidly increases, and reaches the maximum level when the throttle valve is opened to a relatively small opening, and since the port 30 of the valve 24 is closed at that time, the above-mentioned maximum vacuum is, when it has once been supplied to the diaphragm chamber 35 of the vacuum advancer 34, trapped in the space including the diaphragm chamber 35 and the passage means 46, 47 and 48 by the checking action of the check valve 36. Therefore, even when the throttle valve 22 is further opened so that the vacuum in the vacuum port decreases from the maximum level, the vacuum advancing of ignition timing provided by the vacuum advancer 34 is maintained at the value corresponding to the maximum vacuum.

When the vacuum in the vacuum port 23 lowers below the set vacuum of the EGR valve 7, the valve 7 is closed so as to stop the exhaust gas recirculation, and at the saim time the vacuum valve 24 is also changed over so that the port 30 is opened, whereby the maximum vacuum trapped in the diaphragm chamber 35 of the vacuum advancer 34 is immediately released so that the vacuum advancing is reduced substantially to zero.

Figure 2:
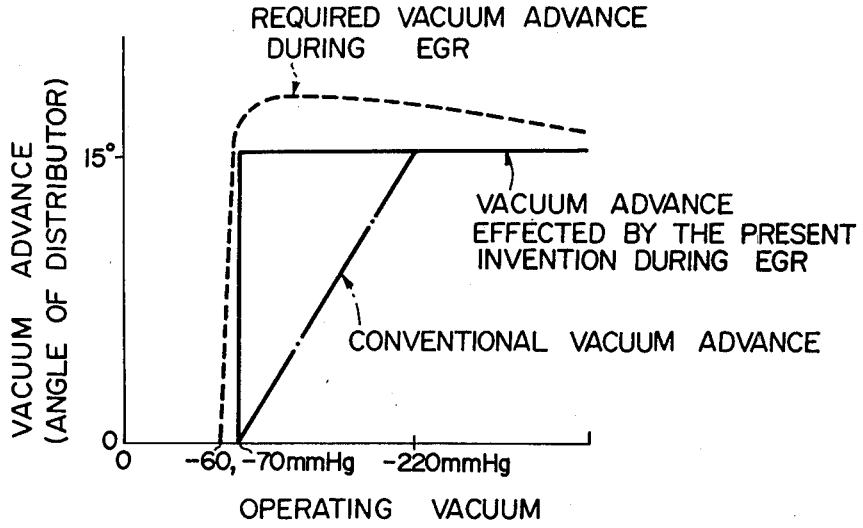
FIG. 2 is a graph showing the vacuum advancing performance of the system shown in FIG. 1 and that of a conventional vacuum advancer for the purpose of comparison.

In the graph of FIG. 2 the vacuum advancing of ignition timing obtained by the control system of the present invention for EGR operation of the engine is shown as compared with the vacuum advancing available from a conventional vacuum advancer. In this graph the ordinate and the abscissa each bear scales for the sake of example only. The vacuum advancing performance desirable for EGR operation of the engine is shown by a broken line in the graph, and it will be appreciated that the vacuum advancing performance obtained by the control system of the present invention shown by a solid line is very close to the aforementioned desirable performance.

Figure 3:
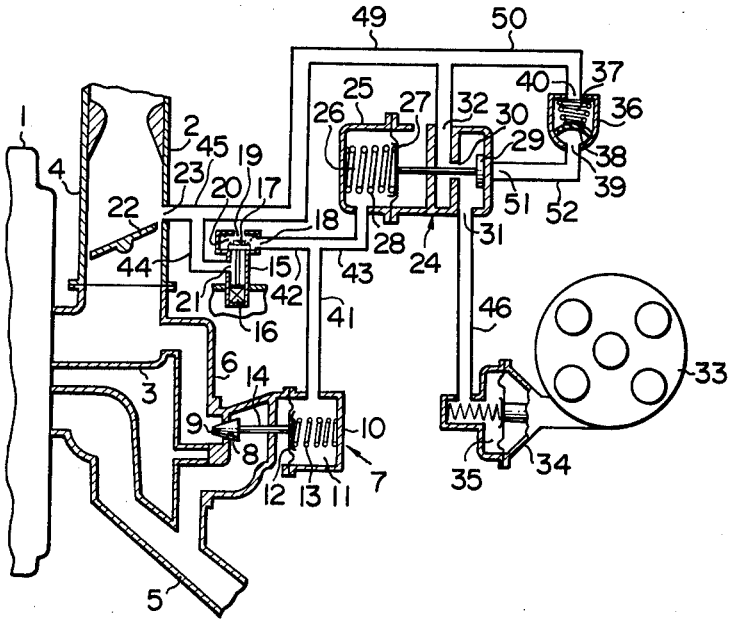
FIG. 3 is a view similar to FIG. 1 showing a modification of the system shown in FIG. 1.

FIG. 3 is a view similar to FIG. 1 showing a modification of the EGR/ignition timing control system shown in FIG. 1. In this modification the vacuum valve 24 has another port 51 which is connected with the port 39 of the check valve 36 by a passage means 52. Since the other parts of the system shown in FIG. 3 are the same as the corresponding parts in the system shown in FIG. 1, the corresponding parts in FIG. 3 are designated by the same reference numerals as attached in FIG. 1 and any detailed descriptions about these same parts will be omitted in order to avoid redundancy. It will also be apparent that the system shown in FIG. 3 operates substantially in the same manner as the system shown in FIG. 1.

Although the EGR control systems shown in FIGS. 1 and 3 do not incorporate a back pressure control system which defines a back pressure chamber having a substantially constant and atmospheric pressure in front of an EGR valve port such as the port 8, they may be modified so as to incorporate such a back pressure control system as shown, for example, in the co-pending patent application filed at the same time as the present application by the same applicant as the present application and assigned to the same assignee as the present application.

Although the invention has been shown and described with respect to some preferred embodiment thereof, it should be understood by those skilled in the art that various changes and omissions of the form and detail thereof may be made therein without departing from the scope of the invention.

I claim:

1. In an internal combustion engine having an intake system which has an intake passage, a throttle valve incorporated in said intake passage, and a vacuum port which opens to said intake passage at a position which is upstream of said throttle valve when it is fully closed and which is downstream of said throttle valve when it is opened beyond a predetermined opening, an EGR system having an EGR passage and an EGR valve which has a first diaphragm means and opens said EGR passage when said first diaphragm means is supplied with a vacuum greater than a predetermined level, and a vacuum advancer which has a second diaphragm means and advances ignition timing in accordance with the vacuum supplied to said second diaphragm means, an EGR/ignition timing control system comprising a vacuum valve which has a third diaphragm means, a valve element operated by said diaphragm means and a valve port which is closed by said valve element when said third diaphragm means is supplied with a vacuum greater than a predetermined level, a check valve, first, second and third passage means which individually connect said first, second and third diaphragm means to said vacuum port, said second passage means incorporating therein a parallel connection of said valve port of said vacuum valve and said check valve, and said check valve being so directed as to allow fluid to flow only from said second diaphragm means toward said vacuum port.

2. The system of claim 1, wherein said vacuum valve has a housing which has first, second and third ports, wherein said first and second ports are connected with each other through said valve port while said first and third ports are directly connected with each other in said housing, wherein said first port is connected with said second diaphragm means by a part of said second passage means while said second and third ports are individually connected with opposite sides of said check valve by other parts of said second passage means.

3. The system of claim 1 or 2, further comprising a thermostat valve incorporated in said first and third passage means, said thermostat valve being adapted to respond to engine temperature and to open said first and third diaphragm means to the atmosphere when engine temperature is below a predetermined value.

* * * * *